United States Patent [19]

Koch et al.

[11] Patent Number: 4,913,217

[45] Date of Patent: Apr. 3, 1990

[54] LOCATORS FOR EXPENDABLE CORE IN DIE CASTING DIE

[75] Inventors: Byron W. Koch, Toledo; John J. McGarigal; R. Matthew Thomas, both of Sylvania, all of Ohio

[73] Assignee: Farley, Inc., Chicago, Ill.

[21] Appl. No.: 300,125

[22] Filed: Jan. 23, 1989

[51] Int. Cl.[4] ..... B22D 17/24

[52] U.S. Cl. ..... 164/340; 164/398; 164/399

[58] Field of Search ..... 164/397, 398, 399, 400, 164/340

[56] References Cited

U.S. PATENT DOCUMENTS

| | | | |
|---|---|---|---|
| Re. 17,121 | 10/1928 | McWane . | |
| 160,062 | 2/1875 | Roberts . | |
| 217,296 | 7/1879 | Quinn et al. . | |
| 239,609 | 4/1881 | Hartman | 164/399 X |
| 974,218 | 11/1910 | Wells . | |
| 1,050,259 | 1/1913 | Waitt | 164/399 |
| 1,563,480 | 12/1925 | Gibson | 164/399 |
| 1,567,605 | 12/1925 | Lee . | |
| 2,042,907 | 6/1936 | McWane . | |
| 2,286,994 | 6/1942 | Nocar . | |
| 3,401,738 | 9/1968 | Parille | 164/353 |
| 3,720,397 | 3/1973 | Voegele | 249/57 |
| 4,077,458 | 3/1978 | Hayashi et al. | 164/11 |

FOREIGN PATENT DOCUMENTS 3109563 10/1982 Fed. Rep. of Germany .

OTHER PUBLICATIONS

Abstract of Japanese Patent Publication 56-14050, published Feb. 10, 1981.

Abstract of Japanese Patent Publication 58-148046, published Sep. 3, 1983.

Abstract of Japanese Patent Publication 59-189057, published Oct. 26, 1984.

Abstract of Japanese Patent Publication 60-102248, published Jun. 6, 1985.

*Primary Examiner*—Richard K. Seidel

*Assistant Examiner*—J. Reed Batten, Jr.

*Attorney, Agent, or Firm*—Hugh Adam Kirk

[57] ABSTRACT

The locating pins have notched ends, each of which simultaneously restricts the movement of an expendable core in two orthogonal directions in a die casting die. A plurality of these pins alone and with other pins project into the space between the printout cavity in a die casting die and the printout portion of an expendable core positioned in that cavity. Other pins having flat ends locate the core in only one directional line. Still other pins having tapered ends require special pockets in the printout section of the core, which pockets have sides that must be formed adjacent to the tapered surfaces of these pins. The configurations of the space around the printout portions of the cores permit molten metal injected into the die to produce a skin or skull over the printout portions, which skin can have thicker ribs or portions through it for further reinforcing the printout portions. These printout portions on the parting line between two dies may have restrictions at the junction of the printout portion with the main portion of the core to form break-off rings. These rings and ribs may be formed either in the die or in the printout portion of the core, or both.

30 Claims, 7 Drawing Sheets

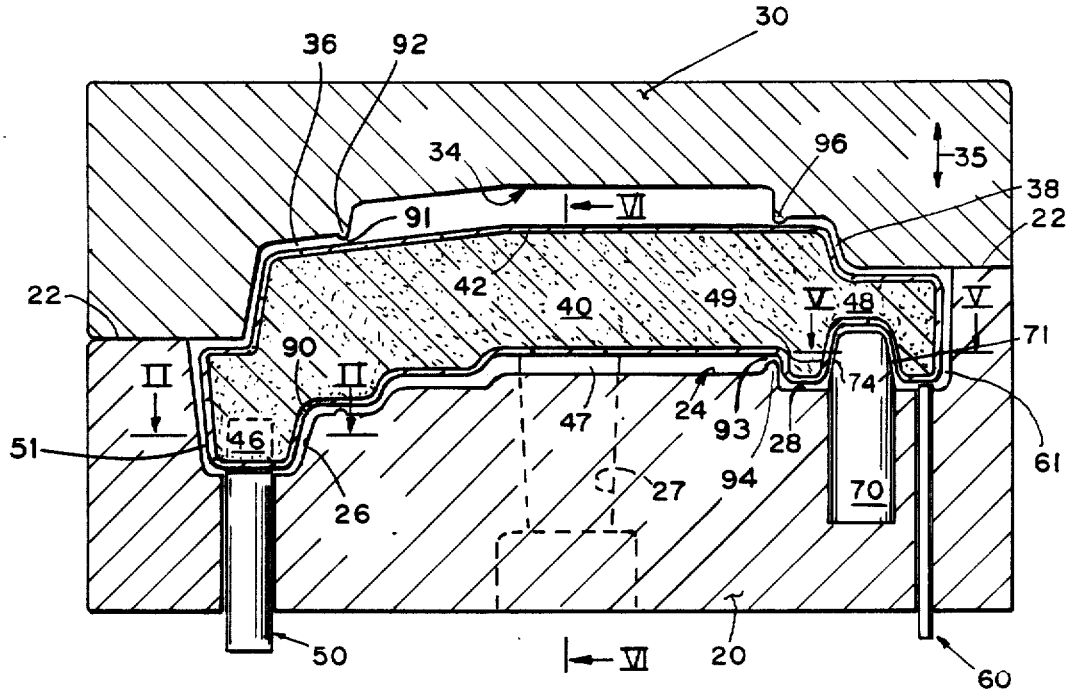
Fig I

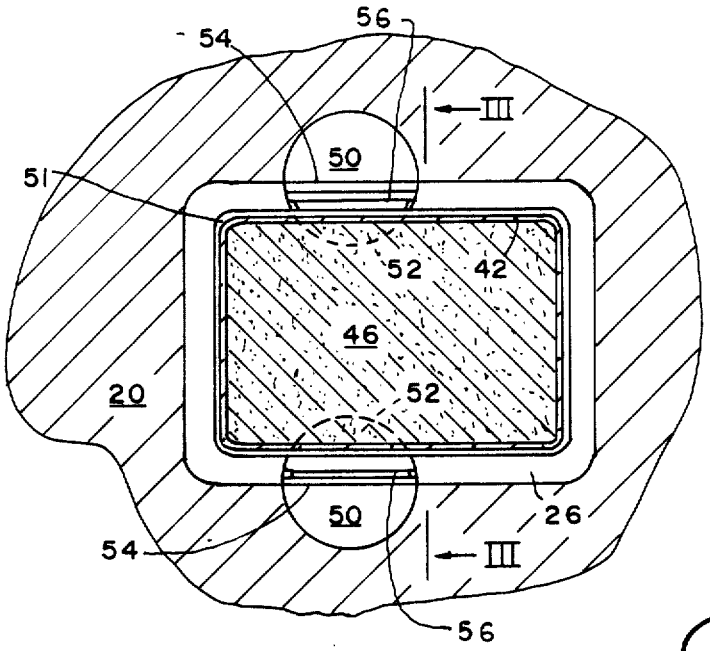
Fig II
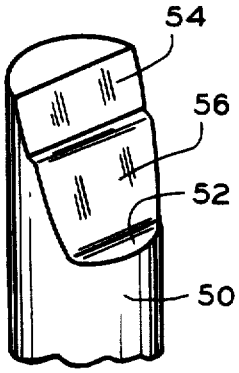
Fig IIA
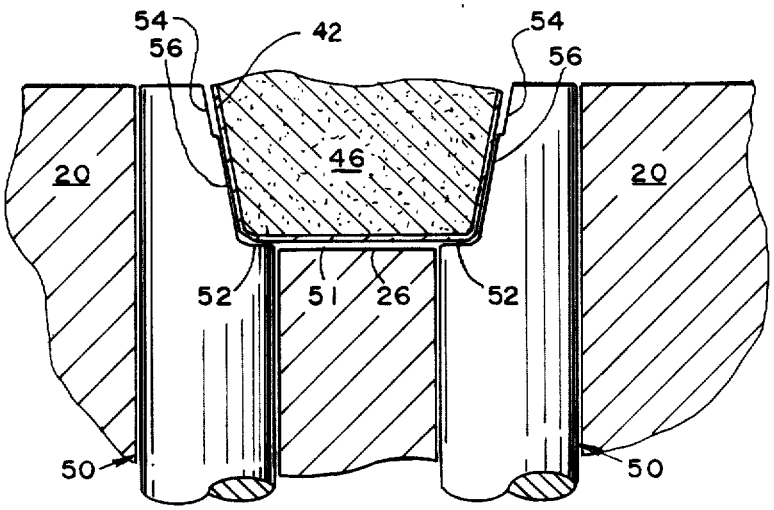
Fig III

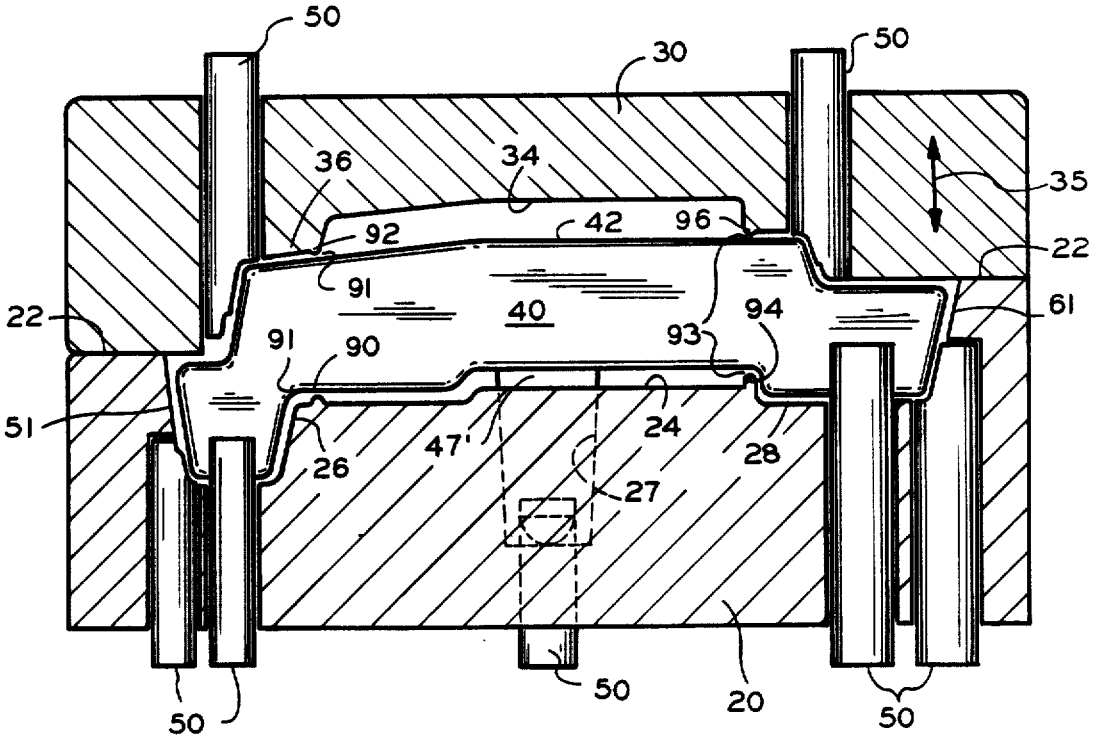
Fig IV

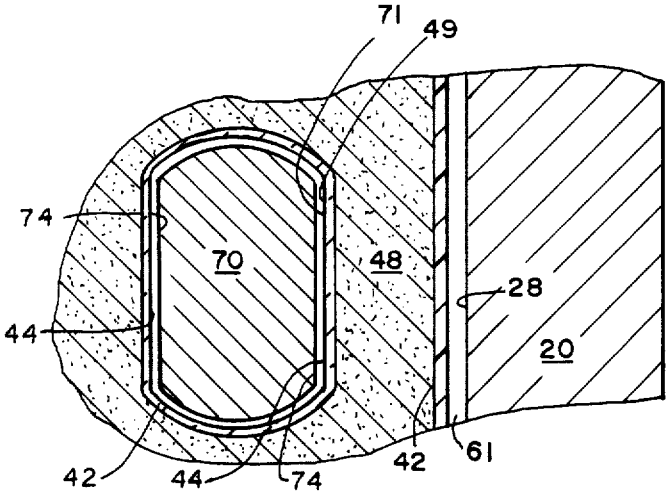
Fig V
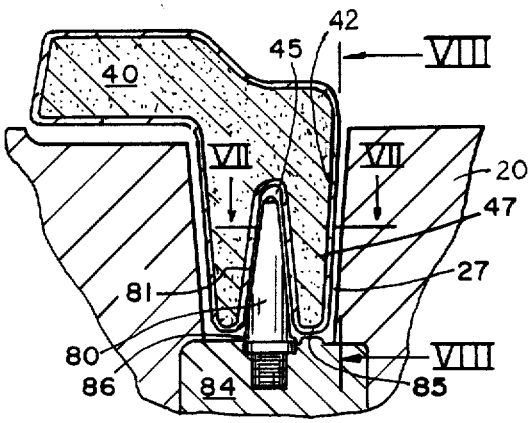
Fig VI
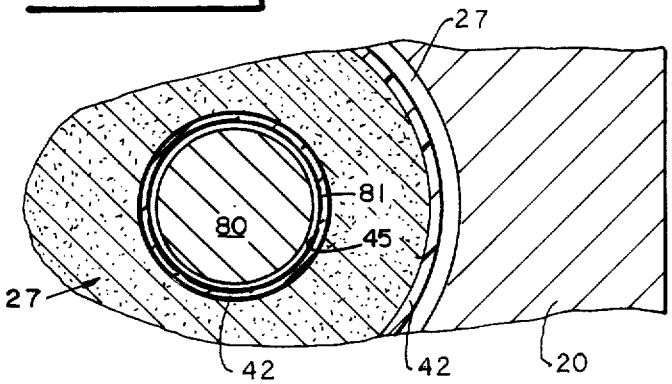
Fig VII

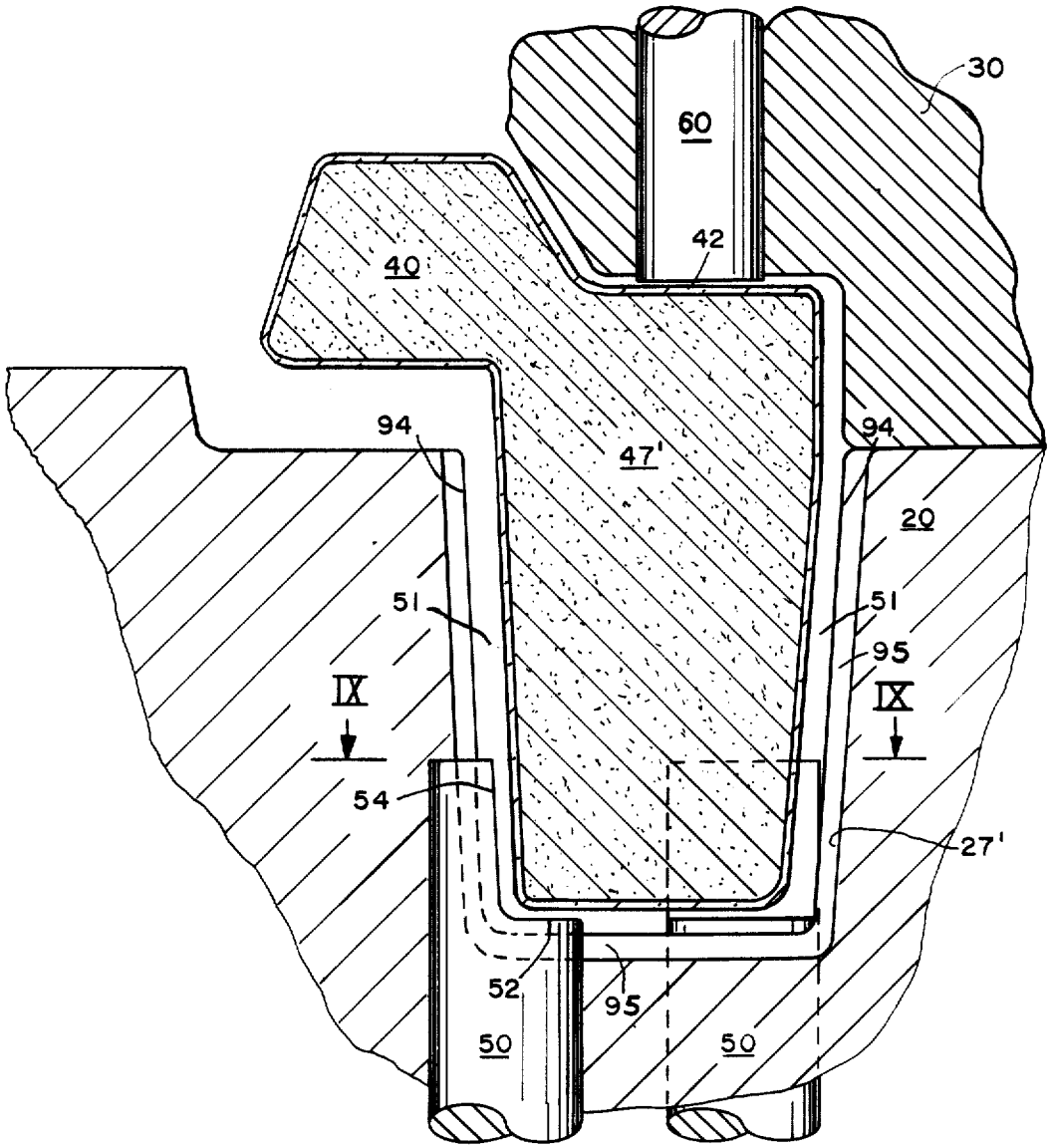
Fig VIII

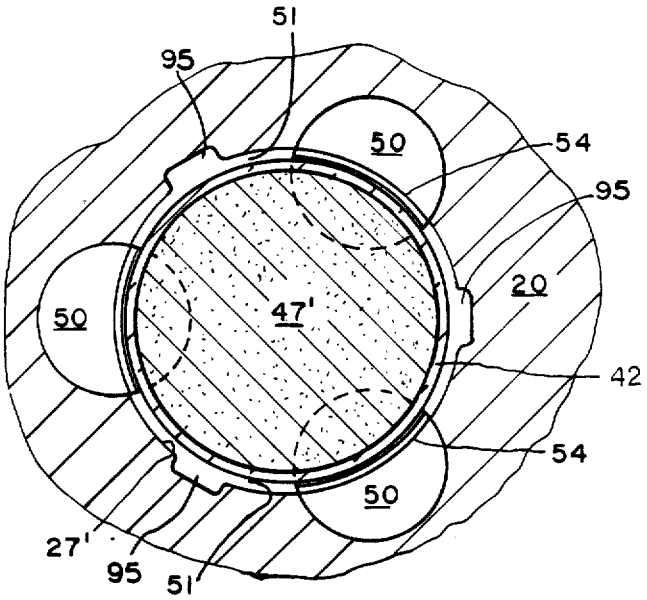
Fig IX

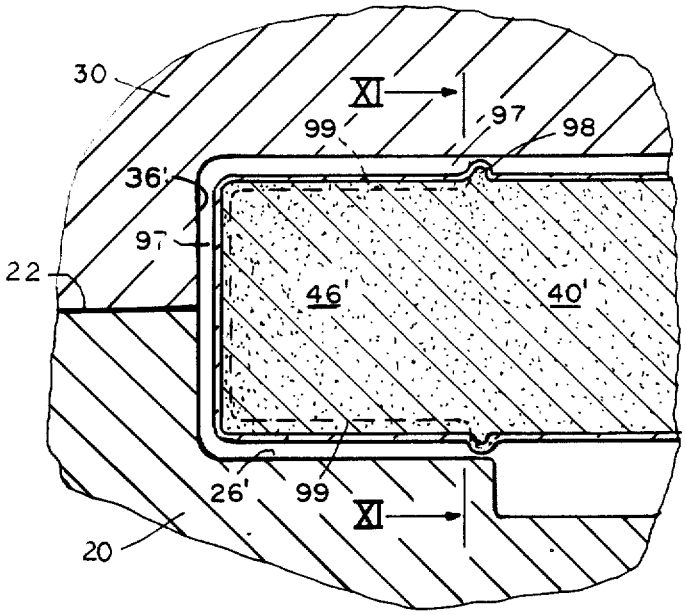
Fig X
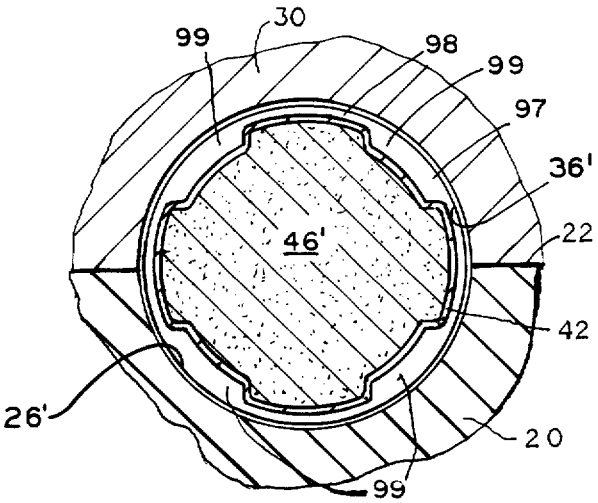
Fig XI

LOCATORS FOR EXPENDABLE CORE IN DIE CASTING DIE

BACKGROUND OF THE INVENTION

Expendable cores for forming undercut regions in die casting dies for high pressure die casting machines require special means for their support, location and positioning of said cores in said dies. First of all, these expendable cores must deteriorate after the casting has been formed in the die so that they will shake out of the casting easily. Thus, these cores previously have been composed primarily of sand with special binders and impenetrable and release coatings, such as the cores and coatings described in applicants' assignee's U.S. patents to Page 4,298,051 issued Nov. 3, 1981; 4,413,666 issued Nov. 8, 1983; 4,766,943 issued Aug. 20, 1988; Dybala et al 4,529,028 issued July 16, 1985 and Downing copending application S.N. 07/173,558 filed Mar. 23, 1988 and now abandoned. Also these coated cores must withstand the high pressures and temperatuers of molten metal, such as molten aluminum, in the die casting die until the molten metal or aluminum has solidified sufficiently to form the casting. Furthermore, the outer surface of the core must not stick to the casting or to the printout cavities or sockets in the die into which the printout portions of the core are placed before the partable dies are closed and hot metal is injected into the die.

These expendable cores may be placed in any one or more parts of the dies, that is, the drag, the cope or cover, and/or the slides. Usually they are located along the parting line of the die parts for each placement. Because of the relatively brittle composition of the cores, if they are positioned too rigidly in the printouts, the very closing of the die and/or the high pressure injection of the hot metal could cause fracture of the cores. Accordingly, a space is provided between the outside surface of the printout portion of the core and the inside surface of the printout cavity in the die so that the core loosely fits or floats in its position in the die. However, on the other hand, if the space or clearance is too great, the core may fall out and/or will not be properly located in the casting so that the casting may have a thinner wall on one side thatn the other. Thus the cores also must be centered in their printout cavities.

Previously there have been many supports for cores in castings for forming undercut regions in the castings, even including means for adjusting the position of the cores in the dies or molds. In die casting dies there have been placed pins with flat ends. often referred to as "Leroy" pins, which bridge about half of the space between the printout cavity and the printout portion of the core for restricting the movement of the core in the direction of draw or relative movement of the partable dies. Then, to prevent movement in other directions, centering pins have been employed which have tapered ends that fit in sockets or pockets in the printout portions of the cores. The surfaces of these tapered ends are parallel with adjacent preformed tapered surfaces in these pockets, so that these centering pins restrict movement of the cores in linear directions orthogonally to that of the previously mentioned Leroy pins. The fact that the centering pins cannot be made to wedge or contact the adjacent parallel surfaces in the pocket in the printout portion of the core without locating the cores so rigidly that it could be broken by the closing of the die, there also must be provided a space between these parallel surfaces. The forming of these centering pins with their special tapered surfaces and corresponding pockets with corresponding tapered surfaces in the printout portion of the cores, materailly complicate the adjustment and manufacture of both the dies and the cores.

Because of the looseness of the core in its printout cavities in the die, the molten metal also fills the space between the printout cavity and the printout portion of the core, forming a film or skull over the printout portions of the core. This film also tends to maintain the position of the core in the die, as well as to strengthen the printout portion of the core. In this latter respect, grooves have been provided in the printout cavity or in the surface of the printout portion of the core, or both, for further reinforcing the skull with ribs therein, formed by the molten aluminum as it fills the space and grooves between the printout portions of the core and the printout cavities.

Furthermore, there have been provided ridges at the neck of the printout portion of the core located at the parting line of the dies, which ridges reduce the thickness of the skull at its neck to form a breakoff ring. This permits easy removal of the printout portion of the core for access to the core for easy removal of the core.

Thus, many of the previously known means for locating an expendable core in the die of a die casting machine have certain disadvantages and it is the purpose of this invention to overcome at least some of these disadvantages.

SUMMARY OF THE INVENTION

Generally speaking, this invention deals with a means for supporting, positioning and/or locating expendable cores in die casting dies of a high-pressure die casting machine for casting parts from molten aluminum and other metals. These cores may be employed to form undercut and other sections or regions in a casting which cannot be formed by core pins. Since these cores are adapted for mass production operation, they must be easily located in the die during the time the die is opened and after the previous formed casting is ejected. For locating the core or cores in the die, there are provided at least one and preferably two or more printout cavities or sockets in the die into which correspondingly sized and shaped printout portions on each core are formed for supporting that core. However, as pointed out above, in view of the brittleness of the cores, since they must be expendable, there must be provided a clearance or space around the printout sockets in the die and the printout portions on the cores so as to permit the cores to float. This space or clearance between the core printout portions and the printout cavities in the die usually varies between about four and two hundred thousandths of an inch (or between about 0.1 and 5 millimeters), and preferably between about ten and sixty thousandths of an inch (or between about 0.25 and 1.5 millimeters). This space between the printout portion of the core and the printout cavity in the die permits the core to float sufficiently so that the closing of the die and/or the hot injection of molten metal under high pressure will not cause the core to fracture. On the other hand, there must be some means in order to properly center the core so that it will not form a casting with too thick and/or too thin a wall along the region formed by the core.

The new core locating pins according to this invention have obtuse angled notched ends which fit into the outer corners of the printout cavity or cavities of the die so as simultaneously to restrict movement of the core in at least two orthogonal directions. These new locating pins bridge about half the space or clearance between the printout portion of the core and the printout cavity in the die. A plurality of these pins may be provided at spaced and preferably opposite sides of the same printout cavity or spaced printout cavities in the same core for simultaneously locating the core in more than one orthogonal direction. Thus, the number of other Leroy and/or centering pins required for locating the core may be materially reduced. The notched surfaces on the ends of these pins are greater than 90° and preferably less than 135° so that the printout portions of the core are easily removed from the die. The corner edges of the printout portion of the core at the new pin locations are similarly angled so as to provide adjacent angular surfaces for restricting the core's movements.

It is to be understood that other and prior known pins, such as Leroy pins and centering pins, may also be employed in combination with the new pins of this invention in the same or preferably other printout cavities in the same die for the same or other cores. The prior Leroy pins usually have flat orthogonal ends that project about halfway into the space and restrict movement of the core only in the direction of the parting of the dies. The centering pins comprise tapered surfaces which correspond with tapered surfaces in pockets in the printout section of the core, and thus usually restrict movement in opposite directions along a line orthogonal to that of the direction of the parting of the dies, but are limited to locating and restricting movement of the core only in their close vicinity.

Since the core must float in its printout cavities, the ends of all the pins only reduce the clearance with the core printout portion to between about 0.002 and 0.16 inch (or between about 0.05 and 4 millimeters), and preferably to about 0.025 inch (or about 0.6 millimeter).

All of the pins employed may be replaced when they wear beyond the point where they can no longer maintain the proper clearance desired. However, the composition of these pins is preferably made of highly durable material such as tool steels, ceramics, and the like.

Since there is a space between the printout cavity in the die and the printout portion of the core, this space is filled with molten metal to form a skin or skull over the printout portion of the core and also to balance the hydraulic forces of the molten metal injected into the die. This not only strengthens the core, but also aids in centering or positioning the core in the die. Furthermore, there may be provided grooves either in the core or the printout cavity for further filling with molten aluminum to form reinforcing ribs around or along the printout portion of the core. These ribs hereinafter have been called "bootstraps" or "bootstrapping".

At the junction between the printout portion of the core and the core itself that is located on the parting line of the die, there may be provided a groove to aid in the break-off of the printout portion of the core from the core itself. This groove is formed by a ridge or ring around the mouth or neck of the printout portion or cavity in the die to reduce the thickness of the skull at this juncture.

OBJECTS AND ADVANTAGES

It is an object of this invention to produce a simple, efficient, effective and economic die casting die with plural pin means therein for positioning expendable cores.

Another object is to provide such plural pin means for positioning expendable cores to produce castings of uniform wall thickness in the core portion of the casting.

Another object is to produce pins in a die for supporting an expendable core, which core is easily removed from the die and doesn't stick to the die.

Another object is to provide a printout cavity in a die for an expendable core in which the core loosely fits to prevent breaking thereof, but yet has means for restricting its movement for proper location in the casting made therefrom.

Another object is to provide specific pin means in the space between a printout cavity in a die and the printout portion of a core to restrict rotating, turning, sidewise, horizontal, and vertical movements of the core in a die and its casting in all three major direction liens.

Still another object is to provide an expendable core with an easily broken juncture between its printout portion and the core itself.

BRIEF DESCRIPTION OF THE DRAWINGS

The above mentioned and other features, objects and advantages and a manner of attaining them are described more specifically below by reference to embodiments of this invention shown in the accompanying drawngs wherein:

FIG. I is a schematic sectional view of a die casting die having an expendable core therein supported, located and/or positioned by pins according to a preferred embodiment of this invention, as well as other type pins;

FIG. II is an enlarged sectional view taken along lines II—II of FIG. I showing the ends of the new locating pins according to this invention;

FIG. IIA is a perspective view of the end of the new locating pins of this invention shown in FIGS. I, II and III;

FIG. III is a view taken from the direction of lines III—III in FIG. II showing the pins in full relief and their notched obtuse angular locating surfaces;

FIG. IV is a view of the core similar to that shown in FIG. I, but showing only a plurality of the new locating pins of this invention in both the drag and the cover dies for holding only the outer edges of the printouts of the core;

FIG. V is an enlarged section taken along line V—V of FIG. I showing a centering type of locating pin projecting into a pocket in another printout portion of the die shown in FIG. I;

FIG. VI is a sectional view taken along line VI—VI of FIG. I showing a third printout portion on the core shown in FIG. I, and both a conical centering pin and a Leroy-type pin projection in the die;

FIG. VII is an enlarged sectional view taken along line VII—VII of FIG. VI showing a conical centering pin in a conical pocket in a printout portion of a core;

FIG. VIII is an enlarged view of a printout portion similar to that shown in FIG. VI but showing part of the cover die with a Leroy pin in it and a plurality of the new pins as shown in FIGS. I, II, IIA, III and IV instead of the centering pins shown in FIGS. VI and VII;

FIG. IX is a section taken along line IX—IX of FIG. VIII showing the three equally angularly spaced new pins around the cylindrical tapered printout portion of the die and also including the reinforcing grooves in the surface of the printout cavity in the die in between the pins;

FIG. X is an embodiment of a break-off neck and ribs formed in the printout portion of a core rather than in the printout cavity as shown in FIG. I; and FIG. XI is a sectional view taken in the direction of the arrows along line XI—XI in FIG. X including reinforcing grooves in the printout portion of the core.

DETAILED DESCRIPTION OF PREFERRED EMBODIMENTS

Referring first to FIGS. I and IV there is schematically shown in section a drag die 20 and a cope die 30 closed thereon along parting line 22 between the two dies. The drag die 20 has a casting cavity 24 and three printout cavities 26, 27 and 28, respectively, into which cavities there are provided different types of locating pins 50, 60, 70 and 80 (see FIGS. VI and VII).

The cope or cover die 30 is provided also with a cavity 34 for the casting part, and at the left and right ends thereof a portion of printout cavities 36 and 38 completing the cavity for the printout portions 46 and 48 of the core 40. In FIGS. IV and VIII, the cope die is also shown to have locating pins 50 and 60, respectively.

In the cavities 24 and 34 shown between the partable dies 20 and 30 there is shown in section an expendable core 40 having a release coating 42 and correspondingly three separate printouts 26, 36, 27 and 28, 38.

Referring now more specifically to FIGS. II, IIA and III, there are shown the new locating pins of this invention, which in figs. IIA and III are shown to be notched at an obtuse angle at their upper ends to provide two angular surfaces greater than 90° and less than about 135° with respect to each other, and correspond to the angular surfaces of the side and bottom along the outer corner edges of the printout portion 46 of the core 40. The notched surfaces 52 and 54 of each of the pins 50 partially and preferably bridge about half of the space 51 between the outer angular surfaces of the printout portion 46 of the core and the corresponding angular surfaces of the printout cavity 26. At the angled portions 52 and 54 of the notches on the pins 50 there also may be provided a slight elevated portion 56 for narrowing the space between the core printout portion 46 and the cavity 26 for better locating and restricting more the movement of the core 40 in the die, but still permitting space even in the notch of each of the pins 50 for filling the space with molten metal or aluminum to form the skull or skin on the printout portion 46 of the core. As shown in FIGS. II and III, the angular sides 54 of the opposite pair of pins 50 restrict sideways movement of the core 40 in both directions along a line orthogonal to the movement in the direction of the draw, which latter movement is simultaneously restricted by the bottom 52 of the notches. Thus movement of the core is restricted simultaneously in two orthogonal directions and the positioning of the core in the die is then more accurately insured to produce more uniform castings during mass production.

Also, if desired, additional new pins 50 may be placed at the outer ends and/or sides of each or different ones of the printout cavities 26, 27, 28, 36 and 38 (see for example in FIGS. IV, VIII, and IX) to restrict movement of the core in the third orthogonal direction. These restrictions in movement may be in both directions in each of the X, Y, and Z axes (all orthogonal to each other) by addition of the new pins 50 to the cover die 30 as shown in FIGS. IV and VIII. Furthermore, in FIG. IV the placing of the pins 50 to engage the outer extremities of the core's printout sections, locates the core more positively than can be obtained by centering pins 70 and 80 in sockets as shown in FIGS. I, V, VI and VII.

Referring again to FIG. I, there is shown at the right in printout cavity 28 a Leroy-type pin 60 which has only a flat end that partially bridges the gap 61 between the printout cavity 28 and the bottom of the printout core portion 48 of the core 40, so as to limit the motion of the core 40 only in the direction of draw of the dies, namely in the direction of the arrow 35 shown for the cope die 30.

Referring now to FIGS. I and V, there is shown also in the printout cavity 28 and printout core portion 48 a pocket 49 into which the tapered end of a centering pin 70 is located. The tapered surfaces 74 of the centering pin 70 do not contact the tapered sides 44 in the pocket 49 in that there also is provided a space 71 between these tapered surfaces. Thus the centering pin 70 does not wedge or fit tightly into the pocket 49 in the core portion 48 of the core 40. However, the space 71 is about half the distance between the opposite and adjacent tapered surfaces of that space or clearance provided in the spaces 51 and 61.

Referring now to FIGS. VI and VII there are shown sections of the cylindrical printout protion 47 of the core 40 which is shown herein to have a central pocket 45 for securing the conical end of centering pin 80. The clearance 81 between the conical center pin 80 and the conical walls of the pocket 45 is similar to the clearance 71 in FIG. V, and less than the clearance 51 and 61, to form a thinner film of molten aluminum in the pocket 45. There is also shown in FIG. VI a modified Leroy-type pin 85 formed integrally with the centering pin support 84.

Referring now to FIGS. VIII and IX, there is shown an enlarged section of the core 40 with a modified cylindrical printout portion 47' that does not have a pocket therein as shown in FIG. VI, but instead the tapered cylindrical printout portion 47' is located by a plurality, namely three, of the new locating pins 50 like those shown in FIGS. I, II, IIA, III, and IV. These pins 50 are equally angularly spaced, about 120° form each other, around the cylindrical lower end of the printout portion 47', thus restricting its movement simultaneously in two orthogonal horizontal and one vertical or draw direction. Thus the pocket 49, the conical centering pin 80, and the extra Leroy-type pin 85 shown in FIG. VI may be replaced by the three new pins 50. Furthermore, in FIG. VIII there is also shown a portion of the cope or cover die 30 with a Leroy pin 60 therein to restrict motion of the core in the other draw driection (see arrow 35 in FIGS. I and IV). Thus, in FIG. VIII, the printout portion 47' is restricted by locating pins 50 and 60 in both directions of all three X, Y, and Z orthogonal axis directions when the die parts 20 and 30 are closed.

Regarding the configurations employed in the printout cavities and/or printout portions of the cores, there is shown hereinat the mouth or neck of the printout cavities 26, 36 and 28, 38 on the parting line 22 of the die parts 20 and 30 in FIGS. I and IV, restricted regions or inwardly extending ribs or ring portions 90 and 92 and 94 and 96 forming narrow spaces 91 and 93 to form an easy break-off groove in the skin or skull of the molten metal or aluminum that forms over the surface coating 42 of the expendable core. If desired, such a break-off groove may be formed by a circumferential ridge 98 in the expendable core 40 at the neck of the parting print-out cavity 26' and 36' as shown in the embodiments of FIGS. X and XI, instead of ribs in the die parts 20 and 30.

Furthermore, the printout cavities may have grooves 95 as shown in Fgs. VIII and IX which form ribs or "bootstraps" of metal over, along and/or around the printout portions of the core for further reinforcing the skull or shell of molten metal or aluminum that forms over the whole outer surface of the printout portions of the core. This film of molten metal or aluminum over the printout portions of the expendable core also aids in preventing the printout portions of the core from sticking in the printout cavities in the die as well as to aid in the centering or positioning and maintaining the position of the core in the die and balancing the hydraulic forces of the molten metal injected into the dies. Similarly, the printout portion 46' of the core 40' shown in FIGS. X and XI may be provided with grooves 99 to form ribs or thicker skin portions in and around the printout portions 46' of the core 40', instead of by grooves 95 in the die part 20 shown in FIGS. VIII and IX.

Normally the spaces or clearances or gaps provided between the outer surface of the coating 42 of the print-out portions 46, 47, 47' and 48 of the expendable cores 40 and 40' and the surface of the printout cavities 26, 36, 27, 27', 28 and 38 in the die parts 20 and 30 into which the printout portions of the core are fitted, range from about four thousandths to two hundred thousandths of an inch (or 0.1 to 5 millimeters) and preferably this space is between about ten and sixty thousandths of an inch (or 0.25 an 1.5 millimeters). The clearance between the adjacent angled surfaces of the locating pins reduces this space to between about two and sixteen thousandths of an inch (or 0.05 and 4 millimeters) and preferably about twenty-five thousandths of an inch (or about 0.06 millimeters). This, in spite of the fact that the locating pins of this invention restrict the movement of the core in the die, they still permit some play of the core in the die and also permit enough space around printout portions of the core to provide an adequate film, skin or skull of metal or aluminum over the printout portions of the die.

While there is described above the principles of this invention in connection with specific apparatus, it is to be clearly understood that this description is made only by way of example and not as a limitation to the scope of this invention.

What is claimed is:

1. A locator for an expendable core in a die casting partable die, said die having a printout socket for a corresponding printout portion on said core, there being a continuous space of less than about five millimeters between the inner surface of said printout socket and the outer surface of said printout portion, means in said printout socket for locating said core, said means comprising: at least one pin means in said printout socket having two adjacent surfaces greater than 90° to each other for partly bridging a similar angle of said space and locating said core in said die simultaneously in at least two directions, one being in the direction of the parting of the die and the other being orthogonally thereto.

2. A locator according to claim 1 including a plurality of said pin means on spaced sides of said printout portion of said core.

3. A locator according to claim 1 wherein said space between said printout portion and said printout socket ranges between about one-tenth and five millimeters.

4. A locator according to claim 3 wherein said space ranges between about one-quarter and one and a half millimeter.

5. A locator according to claim 1 wherein said core has a plurality of printout portions and a corresponding plurality of printout sockets in said die.

6. A locator according to claim 5 including a second pin means projecting into a second printout socket in said die for positioning said core.

7. A locator according to claim 6 wherein said second pin means restricts the motion of said core in the direction of the draw of the partable die.

8. A locator according to claim 7 wherein said second pin means is an integral part of said printout socket in said die.

9. A locator according to claim 6 wherein said second pin means is a centering pin and said printout portion has a recess for said centering pin.

10. A locator according to claim 9 wherein the end of said centering pin has tapered sides and said recess has cooperating tapered sides.

11. A locator according to claim 10 wherein there is a clearance between said tapered sides of said second pin means and said recess, said clearance ranging between about 0.05 and 4 millimeters.

12. A locator according to claim 1 wherein said print-out portion is in the parting line of the die and includes therein a break-off section around the neck of said print-out portion of said core.

13. A locator according to claim 1 including grooves in said space for molten metal to form ribs to reinforce the film of molten metal which surrounds said printout portion of said core in said space.

14. A locator according to claim 1 wherein said pin means extends longitudinally in the direction of draw of said partable die.

15. A locator according to claim 1 wherein said pin means is replaceable in said die.

16. A die casting partable die having a cavity and an expendable core in said cavity, said die cavity having a printout socket for receiving a printout portion of said core, the improvement comprising:

(A) a pin projecting into said printout socket for locating said core, said pin having at its end two adjoining obtuse angular outer surfaces to each other for cooperation with two obtuse angled adjacent sides of said printout portion, and (B) a clearance between said printout socket in said die and said printout portion of said core whereby molten metal can form a film over said printout portion of said core.

17. A die casting die according to claim 16 including a plurality of said pins on spaced sides of said printout portion of said core.

18. A die casting die accoridng to claim 16 wherein said clearance between said printout socket and said printout portion of said core ranges between about one-tenth and five millimeters.

19. A die casting die according to claim 18 wherein said clearance ranges between about one-quarter and one and a half millimeter.

20. A die casting die according to claim 16 wherein said core has a plurality of printout portions and a corresponding plurality of printout sockets in said die.

21. A die casting die according to claim 20 including a second pin projecting into a second printout socket for postioning said core.

22. A die casting die according to claim 21 wherein said second pin restricts the motion of said core in the direction of the draw of the partable die.

23. A die casting die according to claim 22 wherein said second pin is an integral part of said printout socket.

24. A die casting die according to claim 21 wherein said second pin is a centering pin, and said printout portion has a pocket for said centering pin.

25. A die casting die according to claim 24 wherein the end of said centering pin has tapered sides and said pocket has cooperating tapered sides.

26. A die casting die according to claim 25 wherein there is a clearance between said tapered sides of said second pin and said pocket, said clearance ranging between about 0.05 and 4 millimeters.

27. A die casting die according to claim 16 wherein said printout portion is in the parting line of the die and includes therein a break-off section around the neck of said printout portion of said core.

28. A die casting die according to claim 16 including grooves in said clearance for molten metal to form ribs to reinforce said film on said printout portion of said core.

29. A die casting die according to claim 16 wherein said pin extends longitudinally in the direction of draw of said partable dies.

30. A die casting die according to claim 16 wherein said pin is replaceable in said die.

* * * * *

UNITED STATES PATENT AND TRADEMARK OFFICE

CERTIFICATE OF CORRECTION

PATENT NO. : 4,913,217

DATED : April 3, 1990

INVENTOR(S) : Byron W. KOCH et al

It is certified that error appears in the above-identified patent and that said Letters Patent is hereby corrected as shown below:

Column 1, line 21, change "temperatuers" to - - temperatures - - .

Column 1, line 45, change "thatn" to - - than - - .

Column 4, line 23, change "liens" to - - lines - - .

Column 5, line 33, after "separate" insert - - printout portions 46, 47, and 48, respectively, in the die - - .

Column 7, line 6, change "40" to - - 40' - - .

Column 7, line 44, change "0.06" to - - .6 - - .

Signed and Sealed this

Thirtieth Day of July, 1991

*Attest:*

HARRY F. MANBECK, JR.

*Attesting Officer*

*Commissioner of Patents and Trademarks*